US006202648B1

(12) United States Patent
Schumacher et al.

(10) Patent No.: US 6,202,648 B1
(45) Date of Patent: Mar. 20, 2001

(54) METHOD OF AND APPARATUS FOR MAKING A CIGARETTE ROD WITH AN INSERT

(75) Inventors: Peter Schumacher, Hamburg; Andreas Herburg, Trittau; Andreas Rathjen, Hamburg, all of (DE)

(73) Assignee: Hauni Maschinenbau AG, Hamburg (DE)

( * ) Notice: Subject to any disclaimer, the term of this patent is extended or adjusted under 35 U.S.C. 154(b) by 0 days.

(21) Appl. No.: 09/231,635

(22) Filed: Jan. 15, 1999

(30) Foreign Application Priority Data

Jan. 17, 1998 (DE) ..... 198 01 641

(51) Int. Cl.[7] ..... A24C 5/18

(52) U.S. Cl. ..... 131/84.1; 131/84.1; 131/77; 131/83.1; 131/84.3; 131/84.4; 131/38; 131/42

(58) Field of Search ..... 131/84.1, 77, 83.1, 131/84.3, 84.4, 38, 42

(56) References Cited

U.S. PATENT DOCUMENTS 3,736,941 * 6/1973 Molins et al. ..... 131/21
3,987,804 * 10/1976 Molins et al. ..... 131/84
4,648,858 3/1987 Lewis et al. .
4,903,712 2/1990 Strydom .

FOREIGN PATENT DOCUMENTS 2 015 387 12/1970 (DE) .
35 44 322 A1 6/1986 (DE) .
2 260 887 5/1993 (GB) .

* cited by examiner

*Primary Examiner*—Stanley S. Silverman
*Assistant Examiner*—Mark Halpern
(74) *Attorney, Agent, or Firm*—Venable; George Spencer; Robert Kinberg

(57) ABSTRACT

A cigarette rod wherein a flexible tubular insert is surrounded by smokable material which, in turn, is surrounded by a wrapper of cigarette paper is formed by advancing the insert from a source at a variable speed toward one or more stations where the running insert is confined between two layers of smokable material. A combined monitoring and regulating system is provided to monitor the extent of sag of the insert between the outlet of the source and the confining station(s), to generate signals denoting the extent of sag, and to regulate the speed of a motor for the insert at the outlet of the source in response to such signals. The purpose of the combined signal generating and regulating system is to maintain the extent of sag of the insert between an upper threshold value and a lower threshold value.

35 Claims, 3 Drawing Sheets

METHOD OF AND APPARATUS FOR MAKING A CIGARETTE ROD WITH AN INSERT

CROSS-REFERENCE TO RELATED CASES

This application claims the priority of German patent application Serial No. 198 01 641.7 filed Jan. 17, 1998. The disclosure of the German patent application, as well as that of each patent mentioned in the specification of the present application, is incorporated herein by reference.

BACKGROUND OF THE INVENTION

The invention relates to improvements in the methods of and in apparatus for making rods which contain a smokable material, and more particularly to improvements in methods of and in apparatus for making a continuous rod-like smokers' product (such as a cigarette rod) which contains a smokable material (such as comminuted tobacco ribs and/or tobacco leaf laminae) surrounding a flexible insert which may but need not always consist of and/or contain a smokable material.

U.S. Pat. No. 3,987,804 (granted Oct. 26, 1976 to Molins et al. for "MANUFACTURE OF CIGARETTES AND THE LIKE") discloses a cigarette rod wherein the rod-like filler contains an insert in the form of an empty tube or a tube containing a smokable material. The tube is intended to be concentric with a surrounding sleeve-like body of smokable material which is wrapped into cigarette paper or the like. The material of the insert and/or of its contents may but need not be different from that of the surrounding sleeve.

A drawback of the patented method and apparatus is that the position of the filler or insert relative to the surrounding mass of smokable material cannot always be selected and maintained with a desired degree of accuracy. This can affect the quality and/or the appearance of the ultimate product. Furthermore, the patented apparatus is rather complex and the cost of the product which can be turned out in the patented apparatus and/or in accordance with the patented method is relatively high.

OBJECTS OF THE INVENTION

An object of the invention is to provide a novel and improved method of making a continuous rod-like smokers' product wherein the insert is invariably surrounded by and confined in a mass of comminuted tobacco and/or other smokable material in an optimum manner.

Another object of the invention is to provide a method which ensures that the insert is invariably confined in a selected portion of the surrounding smokable material.

A further object of the invention is to provide a method which can be practiced by resorting to a relatively simple, compact and inexpensive apparatus.

An additional object of the invention is to provide a method which renders it possible to produce composite cigarette rods or the like at a rate of speed matching that of makers of cigarette rods without inserts.

Still another object of the invention is to provide a method which renders it possible to reduce the number of rejects.

A further object of the invention is to provide a novel and improved apparatus for the practice of the above outlined method.

An additional object of the invention is to provide a cigarette rod making machine which can be readily and automatically adjusted to select or correct the position of the insert relative to the surrounding mass of smokable material.

Another object of the invention is to provide an apparatus which can be set up to ensure that the position of the insert relative to the surrounding smokable material can be automatically adjusted within a desired or selected range.

SUMMARY OF THE INVENTION

One feature of the invention resides in the provision of a method of making a continuous rod-like smokers' product which contains a smokable material (such as comminuted tobacco leaves, fragments of reconstituted tobacco and/or fragments of artificial tobacco) surrounding an elongated flexible tubular insert. The improved method comprises the steps of establishing for the insert an elongated path including spaced-apart first and second sections or stations, advancing the insert at the first section toward the second section at a first speed which is within a first range of speeds, advancing the insert at the second section in a direction away from the first section at a second speed which is within a second range of speeds so that, owing to its flexibility, the insert sags between the first and second sections when the first speed exceeds the second speed and the extent of sag of the insert between the first and second sections is adapted to be varied by changing at least one of the first and second speds, at least partially surrounding the insert with a smokable material in a region past the second section of the elongated path, monitoring the extent of sag of the insert between the first and second sections and generating signals having characteristics denoting the extent of monitored sag, and regulating at least one of the advancing steps as a function of the characteristics of the signals.

One of the ranges of speeds (for example, the second range) can be zero.

The insert can be empty or it can contain a smokable material.

The method can be carried out in such a way that the extent of sag of the insert between the first and second sections of the elongated path is variable between preselected upper and lower threshold values, and the regulating step of such method can include regulating the at least one advancing step (e.g., the step of advancing the insert at the first section of its path) to maintain the extent of sag between the two threshold values. Furthermore, the regulating step can be initiated (started) when the extent of sag reaches one of the two threshold values. Such regulating step can include increasing the first speed when the extent of sag reaches the lower threshold value or reducing the first speed when the extent of sag reaches the upper threshold value.

Alternatively, the regulating step can include changing the first speed when the extent of sag of the insert between the first and second sections of the elongated path reaches the one threshold value, and thereupon changing at least one of the first and second speeds to maintain the extent of sag between the two threshold values.

Still further, the regulating step can include stepwise changing the at least one advancing step when the extent of sag of the insert reaches the one threshold value until the extent of the sag assumes a value (e.g., a preselected value) between the upper and lower threshold values. The step of changing the at least one advancing step in a stepwise fashion can be carried out with a predetermined delay after the extent of sag reaches the one threshold value.

The surrounding step can include accumulating a layer of smokable material on a foraminous conveyor (e.g., at the underside of the at least substantially horizontal lower reach of the endless air-permeable belt conveyor beneath the perforated bottom wall of a suction chamber), and transporting the layer of smokable material downstream of the second section at a predetermined offset relative to the elongated path of the insert between the first and second sections of such path. The surrounding step can further include admitting into the elongated path additional smokable material which overlies the insert and the layer being transported by the foraminous conveyor downstream of the second section as seen in the direction of advancement of the insert beyond the second section. The admitting step can include showering additional smokable material onto the insert and onto the layer being transported by the foraminous conveyor. Such method can further comprise the step(s) of trimming or equalizing the layer on the foraminous conveyor and/or the additional smokable material at or beyond the second section of the elongated path. Still further, such method can comprise the step of deforming successive increments of the insert downstream of the second section through an angle which is a function of the aforementioned offset. The deforming step can include subjecting the insert to the action of a rotary deforming member (such as an idler roller or a driven roller) downstream of the second section.

The method can further comprise the step of confining the insert and the surrounding smokable material in a tubular wrapper (e.g., a web of cigarette paper). As already mentioned above, the surrounding step can comprise enclosing the insert in plural layers of smokable material (such as a first layer which is transported by the foraminous conveyor and a second layer which is obtained as a result of the aforementioned showering step). The smokable material of at least one of the plural layers is or can be equalized prior to the confining step.

Another important feature of the invention resides in the provision of an apparatus for making a continuous rod-like smokers' product (such as a cigarette rod) which contains a smokable material surrounding an elongated flexible (hollow or at least partially filled) tubular insert. The improved apparatus comprises means for advancing the insert from a source (such as an extruder) lengthwise in a predetermined direction along a predetermined path including spaced-apart first and second sections. The advancing means includes a first unit (such as a variable-speed electric motor) arranged to advance the insert at the first section toward the second section at a first speed within a first range of speeds, and a second unit (e.g., a variable-speed electric motor) arranged to advance the insert at the second section away from the first section at a second speed within a second range of speeds so that, due to its flexibility, the insert sags between the first and second sections when the first speed exceeds the second speed, and the extent of sag can be varied in response to a change of at least one of the first and second speeds. The apparatus further comprises means for at least partially surrounding the insert with smokable material downstream of the second section, and means for monitoring the extent of sag of the insert between the first and second sections of the predetermined path.

The monitoring means preferably includes means for generating signals having characteristics which denote the extent of monitored sag, and such apparatus preferably further comprises means for regulating at least one of the aforementioned units as a function of the characteristics of the signals, i.e., in dependency upon the extent of detected sag. The advancing means can be set up in such a way that the extent of sag of the insert between the first and second sections of the predetermined path is variable between an upper and a lower threshold value, and the regulating means of such apparatus can comprise means for adjusting the at least one unit in order to maintain the extent of sag of the insert between the two threshold values. The signal generating means of the monitoring means can include means for transmitting signals in response to detection of a sag the extent of which at least approximates one of the two threshold values, and the regulating means can further comprise means for adjusting the first unit in response to a change of the extent of sag from one of the threshold values to the other threshold value within a predetermined interval of time. The adjusting means can comprise means for selecting for the first unit of the advancing means a speed at which the extent of sag is between the two threshold values.

The signal generating means can embody means for transmitting signals for stepwise adjustment of the at least one unit of the advancing means in response to detection that the extent of sag at least approximates one of the two threshold values for a predetermined interval of time.

The means for at least partially surrounding the insert with smokable material can comprise a suction-operated foraminous conveyor which is arranged to transport a layer of smokable material downstream of the second section of the predetermined path along a second path which is offset relative to a portion of the predetermined path between the first and second sections of the predetermined path. The means for at least partially surrounding the insert with smokable material can further comprise means for delivering additional smokable material against the layer of smokable material and the insert downstream of the second section of the predetermined path. Still further, the apparatus can comprise means for equalizing the layer and/or the additional smokable material at or downstream of the second section of the predetermined path.

The apparatus can further comprise means for deforming (particularly bending) successive increments of the insert downstream of the second section of the predetermined path so that the deformed increments of the insert lie against the layer of smokable material which is being transported by the foraminous conveyor. Such deforming or bending means can comprise a rotary tool in the form of a roller, wheel or pulley.

The apparatus can further comprise means for draping the insert and the surrounding smokable material into a wrapper (such wrapper can contain or it can consist of cigarette paper) to thus convert the insert, the surrounding smokable material and the wrapper into a tobacco-containing rod, e.g., a cigarette rod. Such tobacco-containing rod is then ready to be subdivided into plain cigarettes, cigars, cigarillos or analogous smokers' products which can be transported to a packing machine or to a filter tipping machine (e.g., a machine wherein plain cigarettes are united with filter rod sections to constitute filter cigarettes).

The novel features which are considered as characteristic of the invention are set forth in particular in the appended claims. The improved apparatus itself, however, both as to its construction and the modes of assembling and utilizing the same, together with numerous additional important and advantageous features and attributes thereof, will be best understood upon perusal of the following detailed description of certain presently preferred specific embodiments with reference to the accompanyig drawings.

DESCRIPTION OF PREFERRED EMBODIMENTS

Figure 1A:
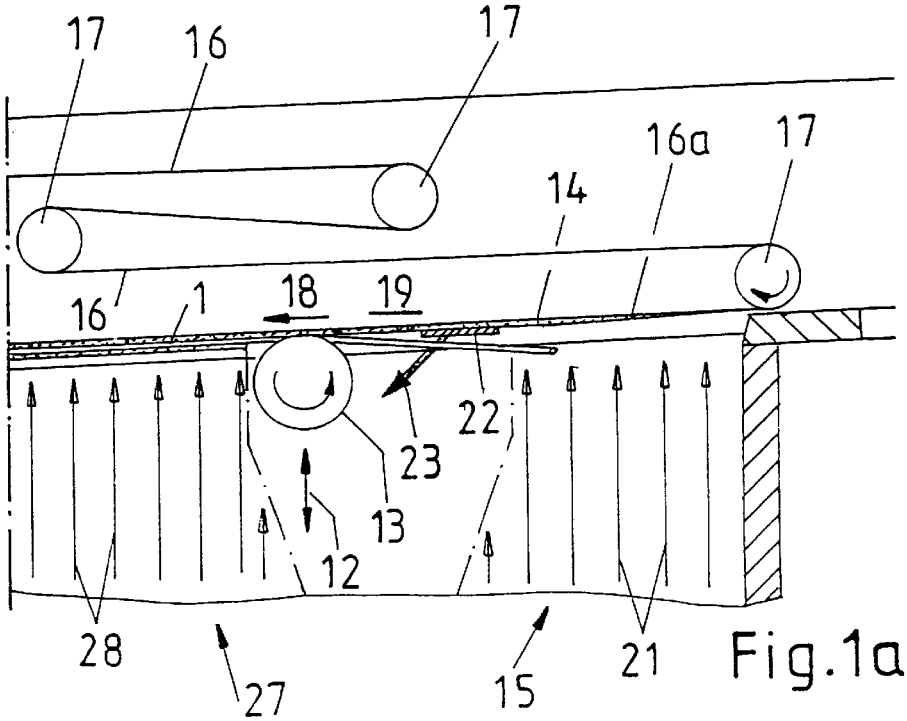
FIG. 1 (composed of FIGS. 1*a* and 1*b*) is a partly side elevational and partly vertical sectional view of an apparatus which embodies one form of the present invention.
Figure 2A:
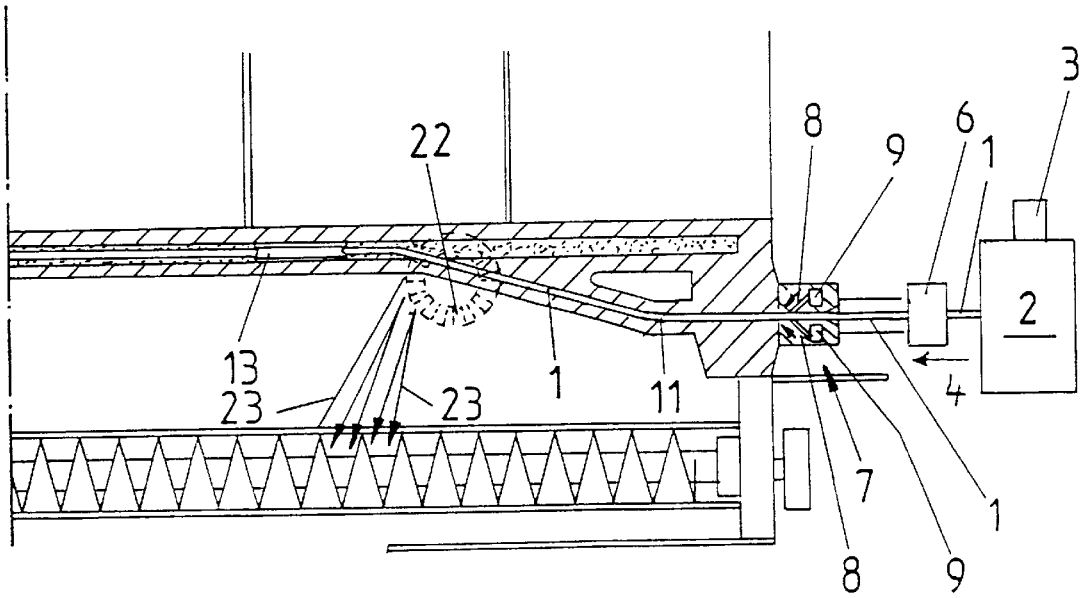
FIG. 2 (composed of FIGS. 2*a* and 2*b*) is a partly bottom plan view and partly horizontal sectional view of the apparatus of FIGS. 1*a* and 1*b*, and further shows a source of a continuous flexible tubular insert as well as the sag monitoring and speed regulating means of the apparatus.
Figure 1B:
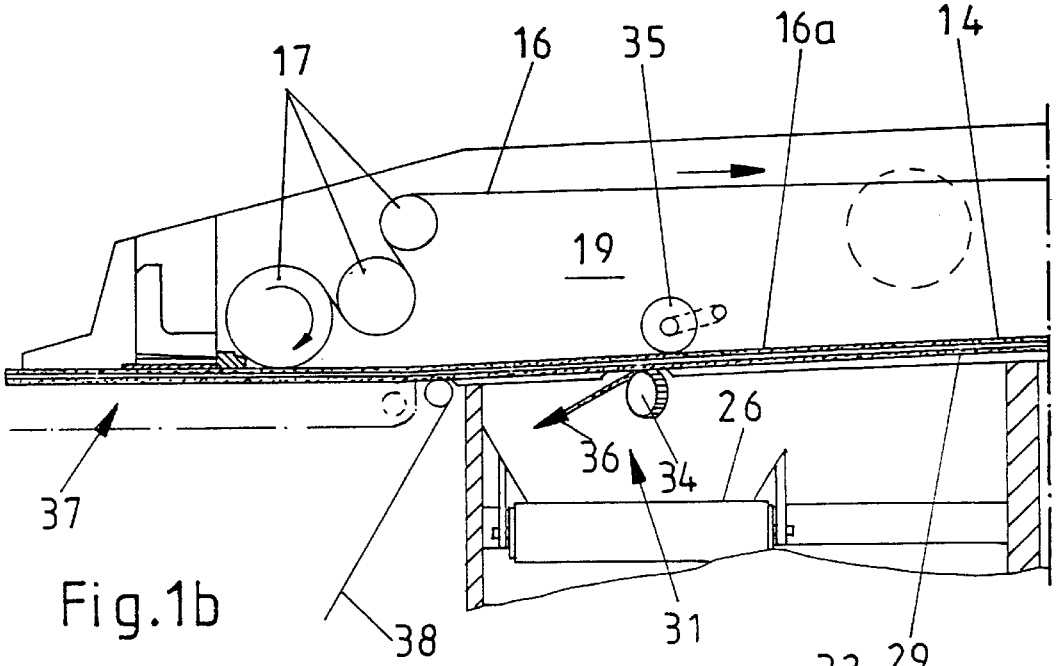
Figure 2B:
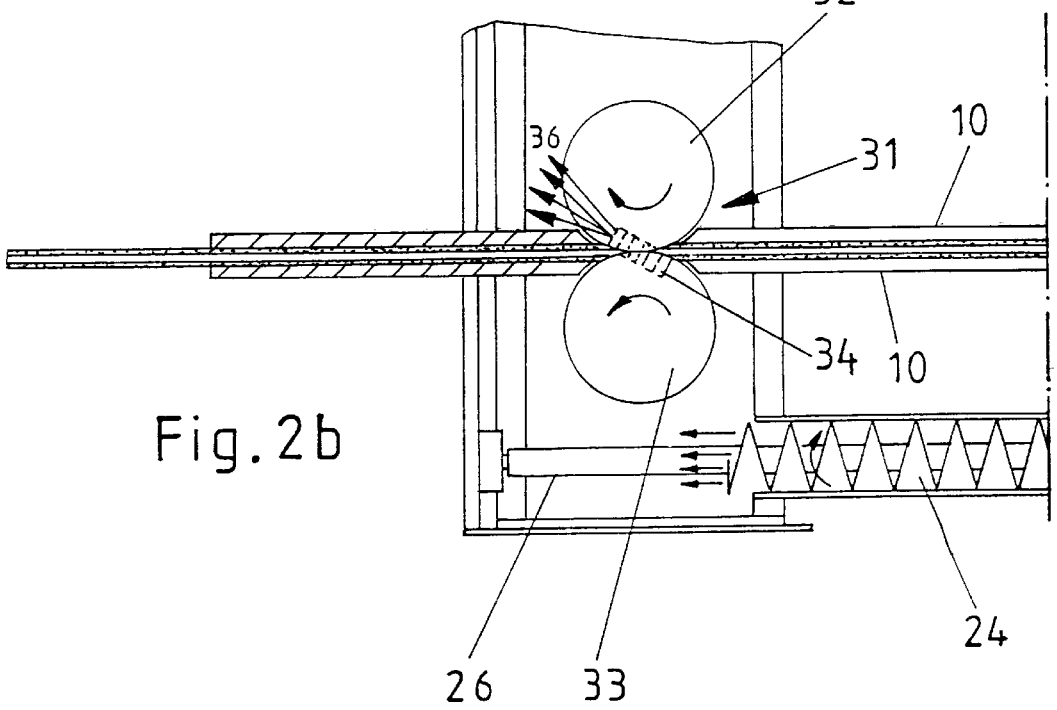

The apparatus which is shown in FIGS. 1*a*, 1*b*, 2*a* and 2*b* is designed to confine an elongated flexible tubular insert 1 in a sleeve-like sheath of smokable material (e.g., comminuted tobacco ribs and/or shredded tobacco leaf laminae) and to thereupon encase the sheath in a web 38 of cigarette paper or other suitable wrapping material so as to form a continuous cigarette rod ready to be subdivided into discrete smokers' products, e.g., into plain cigarettes of unit length or multiple unit length.

The improved apparatus comprises a suitable source 2 (see FIGS. 2*a* and 3) which supplies a continuous flexible tubular insert 1 into an elongated (predetermined) path including a first section at the outlet of the source 2 and a second section at a nozzle 7. The means for advancing the insert 1 along its path (in the direction indicated by arrows 4) includes a first advancing unit 3 (e.g., a variable-speed electric motor which advances the insert 1 from the source 2 at a selected one of a range of first speeds), and a second advancing unit which includes the nozzle 7 and serves to advance the insert 1 in a direction away from the motor 3 at a single second speed or at a selected one of a range of second speeds. In other words, the second range can include a single (second) speed.

The source 2 can include an extruder which supplies the insert 1 at a variable speed determined by the motor 3. The selected first speed may but need not be identical with that imparted to successive increments of the running insert 1 by the second unit which includes the nozzle 7 and is located downstream of the motor 3 (first unit) as seen in the direction of the arrows 4.

The nozzle 7 can be designed to merely assist in advancement of the insert 1 at one of a range of second speeds. At least one of the two units of the advancing means for the insert 1 is adjustable and, therefore, if the selected first speed does not match the single or the selected second speed, the extent of sag of the insert 1 between the outlet of the source 2 and the nozzle 7 increases or decreases. The extent of sag is monitored by a monitoring device or sensor 6 which transmits appropriate signals to a regulating circuit 42 for the adjustable motor 3 and a second variable-speed electric motor 42 for the mobile parts of a wrapping mechanism 37.

The insert can be made of celulose or another suitable material which may but need not furnish a smoke tasting like tobacco smoke. Reference may be had to the disclosure in the '804 patent to Molins et al.

The nozzle 7 has a set of suitably inclined orifices 8 for compressed air which impinges upon successive increments of the running insert 1 and propels the insert in the direction indicated by the arrows 4, i.e., away from the path section at the outlet of the source 2. The nozzle 7 surrounds a portion of the path for the insert 1 and its orifices 8 receive compressed air from one or more plenum chambers 9.

The nozzle 7 is followed by a conduit 11 (FIGS. 2*a* and 3) which defines a portion of the path for the insert 1 downstream of the second section of such path. The conduit 11 delivers successive increments of the insert 1 into the range of a deforming or bending tool here shown as a guide roller 13 which is movable up and down in directions indicated (in FIG. 1*a*) by a double-headed arrow 12. The roller 13 serves to move successive increments of the running insert 1 against the underside of a stream or layer 14 of smokable material adhering to the underside of the substantially horizontal lower reach or stretch 16*a* of an endless foraminous belt conveyor 16. The latter is trained over a set of pulleys 17 at least one of which is driven to advance the lower reach 16*a* in the direction indicated by arrow 18.

The stream or layer 14 is formed at a stream building station 15 which is located ahead of the guide roller 13 and includes a duct serving to convey particles of smokable material in the direction indicated by arrows 21 (FIG. 1*a*). The lower reach 16*a* of the foraminous belt conveyor 16 is caused to advance transversely across the upper end of the duct at the station 15 and attracts the ascending particles because it is caused to advance beneath the air-permeable (e.g., perforated) bottom wall of a suction chamber 19. The lower reach 16*a* and two sidewalls 10 of the device which serves to at least partially surround the insert with fragmentized smokable material define an elongated channel wherein the layer 14 and he insert 1 advance in the direction indicated by the arrow 18, i.e., away from the nozzle 7.

The layer 14 is relatively thin and is preferably trimmed or equalized by a customary trimming or equalizing device 22 serving to remove the surplus 23 of smokable material being supplied by the duct at the stream building station 15. The surplus 23 is accepted by a feed screw 24 which transports it to a take-off conveyor 26. The latter serves to return the surplus 23 into the magazine of a customary distributor which supplies smokable material to the duct at the station 15 as well as to a duct at a second stream or layer building station 27 downstream of the station 15 (as seen in the direction of the arrow 18).

The means for surrounding the insert 1 with a smokable material includes a second duct which is located at the station 27 and serves to deliver a shower of fragmentized smokable material upwardly in the direction indicated by arrows 28. Such particles adhere to the underside of the layer 15 and overlie the underside of the insert 1 because they are attracted toward the underside of the lower reach 16*a* of the foraminous conveyor 16 by suction which is established by subatmospheric pressure prevailing in the chamber 19. The additional smokable material which is supplied to the underside of the lower reach 16*a* of the conveyor 16 at the station 27 forms a second layer 29, and the underside of such second layer is preferably trimmed by a second trimming or equalizing device 31. The illustrated equalizing device 31 comprises two rotary clamping discs 32, 33 and a rotary brush or paddle wheel 34 which serves to remove the surplus 36 extending below the common plane of the discs 32, 33. The surplus 36 is showered onto the take-off conveyor 26 (see FIG. 1*b*) and is also returned into the magazine of the aforementioned distributor.

A vertically adjustable roller 35 which is installed in the suction chamber 19 above the equalizing device 31 serves to select the quantity of surplus 36 which is being removed by the brush or paddle wheel 34. The roller 35 can deform the adjacent portion of the bottom wall of the suction chamber 19 to thus select the distance between the lower reach 16*a* and the plane of the clamping discs 32, 33.

On its way beyond the station 27 (i.e., toward the wrapping device 37), the insert 1 is confined between the two layers 14 and 29 of smokable material. Such layers are draped around the insert 1 in or ahead of the wrapping device 37 to form a sleeve or sheath surrounding the insert and being draped into the cigarette paper web 38. The thus obtained cigarette rod is subdivided by a standard cutoff, and the thus obtained rod-shaped articles (e.g., cigarettes) are processed in a manner as already described hereinbefore.

The manner in which the particles of smokable material are showered into the channel between the sidewalls 10, the manner in which the layers 14, 29 are trimmed by the respective equalizing devices 22 and 31, and the operation of the wrapping device 37 are well known from the field of making plain and filter cigarettes. Reference may be had, for example, to commonly owned U.S. Pat. Nos. 4,721,119 (granted Jan. 26, 1988 to Ludszeweit et al. for "ROD MAKING MACHINE WITH MEANS FOR ADJUSTING THE POSITION OF WRAPPING MATERIAL"), 5,060, 665 (granted Oct. 29, 1991 to Heitmann for "WRAPPING MECHANISM FOR ROD MAKING MACHINES OF THE TOBACCO PROCESSING INDUSTRY), 5,072,742 (granted Dec. 17, 1991 to Heitmann for "METHOD OF AND APPARATUS FOR MAKING A FILLER OF SMOKABLE MATERIAL"), and 5,154,190 (granted Oct. 13, 1992 to Heitmann for "APPARATUS FOR BUILDING A TOBACCO STREAM"). The '742 patent to Heitmann shows a distributor which can be utilized to supply tobacco particles to the stations 15 and 27 in the apparatus of the present invention. The exact construction of the means for forming the layers 14, 29, of the equalizing devices 22, 31, and of the wrapping device 37 form no part of the present invention.

Figure 3:
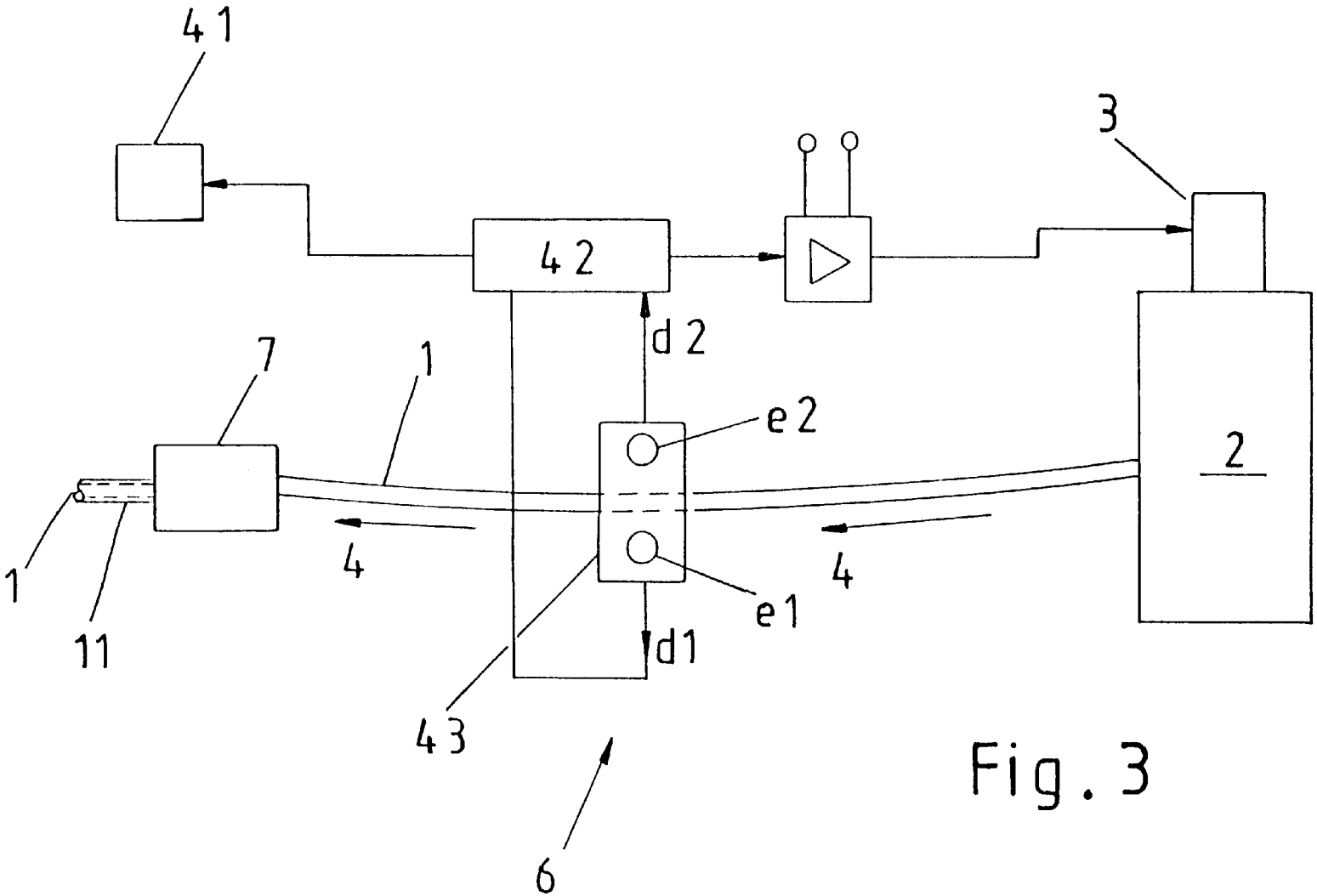
FIG. 3 is a diagrammatic view of the two adjustable units of the advancing means, of the sag monitoring means, and of the speed regulating means.

FIG. 3 shows a presently preferred embodiment of the means for monitoring the extent of sag of the insert 1 between the first section (at the outlet of the source 2) and the second section (at the nozzle 7) of the predetermined path for the insert. The regulator 42 responds to signals transmitted by the monitoring device or sensor 6 and synchronizes the operation of the adjustable unit (electric motor) 3 with that of the adjustable electric motor 41 for the wrapping device 37. The synchronizing action of the regulator 42 is preferably such that the speed of the motor 41 matches that of the motor 3. Nevertheless, it happens that the speed of the motor 3 deviates from the speed of the motor 41, and this necessitates appropriate adjustments of the speed of the insert 1 at the outlet of the source 2.

The monitoring device 6 comprises a signal generator 43 which generates and transmits signals at least when the extent of sag of the insert 1 between the outlet of the source 2 and the nozzle 7 reaches a first threshold value e1 (maximal sag) or a second threshold value e2 (minimal sag). Thus, when the speed of the insert 1 at the outlet of the source 2 exceeds the speed at which the motor 41 causes the wrapping device 37 to advance the finished cigarette rod (including a tubular wrapper of cigarette paper 38, trimmed and shaped layers 14, 29 of smokable material, and the respective portion of the insert 1) away from the wrapping station, the extent of sag of the insert 1 increases toward the threshold value e1. On the other hand, the extent of sag decreases toward the threshold value e2 when the speed of the motor 41 increases and/or the speed of the motor 3 decreases to an extent which ensures that the speed of movement of the insert through the nozzle 7 is higher than the speed of movement of the insert out of the source 2.

The signal generator 43 transmits to the regulator 42 a signal d1 when the extent of sag reaches the threshold value e1, and the signal generator 43 transmits a signal d2 when the extent of sag of the insert 1 reaches the threshold value e2. When the regulator 42 receives a signal d1, the speed of the motor 3 is reduced with attendant reduction of the extent of sag because the regulator 42 does not alter the speed of the motor 41. If the extent of sag remains unchanged or substantially unchanged (i.e., if the signal generator 43 continues to transmit the signal d1), the regulator 42 preferably causes the motor 3 to reduce the sped of the insert 1 at the outlet of the source 2 at predetermined intervals (e.g., in the range of one or more seconds) and by preselected increments until the extent of sag decreases to a desired value, e.g., so that the signal generator 43 ceases to transmit the signal d1.

The signal generator 43 is preferably designed to monitor the duration of that interval of time which elapses between the transmission of a signal d1 and the transmission of a signal d2 or vice versa, i.e., the duration of the interval which elapses while the extent of sag of the insert 1 changes from one of the two threshold values e1, e2 to the other threshold value. If the duration of such interval exceeds a preselected value (e.g., a selected number of seconds), the speed of the motor 3 remains unchanged. On the other hand, if the interval which elapses, for example, while the extent of sag decreases from the threshold value e1 to the threshold value e2, exceeds a predetermined time span, the characteristic of the signal then being transmitted from the signal generator 43 to the regulator 42 is such that the latter increases the speed of the motor 3 to a certain extent so that the extent of sag does not reach the threshold value e2.

If the extent of sag of the insert 1 decreases to the threshold value e2, the speed of the motor 3 is increased in response to the transmission (to the regulator 42) of a signal d2. This causes the extent of sag to increase above the threshold value e2. Such adjustment, too, can be carried out in a stepwise fashion. Furthermore, the signal generator 43 can be readily set up to monitor the interval of time which elapses while the extent of sag increases from e2 to e1. If the interval is too short, the threshold value e2 can be altered toward the threshold value e1.

The just described selections of the construction and mode of operation of the signal generator 43 and the regulator 42 will be readily appreciated by those conversant with the relevant fields of signal generators and regulators upon perusal of the preceding description of the structure shown in FIG. 3. Therefore, the exact details of the signal generator 43 and regulator 42 are not shown in FIG. 3.

If the speed of the insert 1 at the outlet of the source 2 matches or closely approximates the speed of the cigarette rod (as determined by the motor 41), the regulator 42 is idle and the extent of sag of the insert is somewhere between the two threshold values e1 and e2. On the other hand, if the extent of sag of the insert 1 reaches one of the two threshold values, the characteristic of the signal (d1 or d2) is such that the regulator 42 changes the speed of the motor 3 accordingly, i.e., the extent of sag is caused to assume an acceptable value between the threshold values e1 and e2.

The signal generator 43 can employ a standard follower (such as a so-called dancer roller) which rides on the central portion of the insert 1 between the source 2 and the nozzle 7 and causes the signal generator to transmit appropriate signals reflecting the extent of sag of the insert. The follower can influence low-inertia actuator means for suitable initiators which are designed to generate and transmit signals d1, d2 in response to corresponding changes of the extent of sag of the insert between the source 2 and the nozzle 7.

However, it is equally within the purview of the invention to employ conventional contactless (such as photoelectronic) elements which generate signals denoting the positions of the central portion of the loop formed by the insert 1 between the outlet of the source 2 and the nozzle 7.

The extent of deformation or bending of the insert 1 between the nozzle 7 and the channel which is flanked by the sidewalls 10 depends upon the extent of lateral offset of the channel and the path portion between the source 2 and the nozzle 7. Such deformation is effected by the conduit 11 and/or by the tool 13.

An important advantage of the improved method and apparatus is that the quality of the ultimate product is highly satisfactory even if the wrapping device 37 is caused to discharge the continuous cigarette rod at a very high speed. Furthermore, the percentage of rejects (such as tested cigarettes of unit length) is suprisingly low. Still further, the apparatus is capable of operating without interruptions for long periods of time, and such apparatus can employ several constituents of presently known cigarette rod making machines (such constituents include the aforementioned distributor, the wrapping device 37, the equalizing devices 22 and 31, the suction chamber 19 and the foraminous conveyor 16, and others).

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of methods of and apparatus for making a cigarette rod with an insert and, therefore, such adaptations should and are intended to be comprehended within the meaning and range of equivalence of the appended claims.

What is claimed is:

1. A method of making a continuous rod-like smokers' product which contains a smokable material surrounding an elongated flexible tubular insert, comprising the steps of:

establishing for the insert an elongated path including spaced-apart first and second sections;

advancing the insert at the first section toward the second section at a first speed within a first range of speeds;

advancing the insert at the second section in a direction away from the first section at a second speed within a second range of speeds so that, owing to its flexibility, the insert sags between said sections when the first speed exceeds the second speed and the extent of sag is adapted to be varied by changing at least one of the first and second speeds;

at least partially surrounding the insert with smokable material in a region past the second section and accumulating a layer of smokable material on a foraminous conveyor and transporting the layer downstream of said second section at a predetermined offset relative to the path for the insert between the first and second sections;

deforming the insert downstream of said second section of said elongated path through an angle depending upon said offset;

monitoring the extent of sag of the insert between said sections and generating signals having characteristics denoting the extent of monitored sag; and regulating at least one of the advancing steps as a function of the characteristics of said signals.

2. The method of claim 1, wherein the insert is empty.

3. The method of claim 1, wherein the insert contains a smokable material.

4. The method of claim 1, wherein the extent of sag is variable between upper and lower threshold values and said regulating step includes regulating the at least one advancing step to maintain the extent of sag between said threshold values.

5. The method of claim 4, wherein the at least one advancing step is the step of advancing the insert at the first section.

6. The method of claim 4, wherein said regulating step is initiated when the extent of sag reaches one of said threshold values.

7. The method of claim 6, wherein said regulating step includes increasing the first speed when the extent of sag reaches said lower threshold value.

8. The method of claim 6, wherein said regulating step includes reducing the first speed when the extent of sag reaches said upper threshold value.

9. The method of claim 6, wherein said regulating step includes changing the first speed when the extent of sag reaches said one threshold value and thereupon changing at least one of the first and second speeds to maintain the extent of sag between said threshold values.

10. The method of claim 6, wherein said regulating step includes stepwise changing the at least one advancing step when the extent of sag reaches said one threshold value until the extent of sag assumes a value between said threshold values.

11. The method of claim 10, wherein said step of stepwise changing the at least one advancing step is carried out with a predetermined delay after the extent of sag reaches said one threshold value.

12. The method of claim 1, wherein said surrounding step further includes admitting into said path additional smokable material which overlies the insert and the layer being transported by the foraminous conveyor downstream of the second section as seen in said direction.

13. The method of claim 12, wherein said admitting step includes showering additional smokable material onto the insert and onto the layer being transported by the foraminous conveyor.

14. The method of claim 12, further comprising the step of equalizing the additional smokable material subsequent to said admitting step.

15. The method of claim 1, further comprising the step of equalizing the layer.

16. The method of claim 1, wherein said deforming step includes subjecting the insert to the action of a rotary deforming member downstream of said second section of said predetermined path.

17. The method of claim 1, further comprising the step of confining the insert and the surrounding smokable material in a tubular wrapper.

18. The method of claim 17, wherein the wrapper consists of cigarette paper.

19. The method of claim 17, wherein said surrounding step comprises enclosing the insert in plural layers of smokable material.

20. The method of claim 19, further comprising the step of equalizing the smokable material of at least one of said layers prior to said confining step.

21. The method of claim 17, further comprising the step of equalizing the smokable material prior to said confining step.

22. Apparatus for making a continuous rod-like smokers' product which contains a smokable material surrounding an elongated flexible tubular insert, comprising:

means for advancing the insert from a source lengthwise in a predetermined direction along a predetermined path including spaced-apart first and second sections, said advancing means including a first unit arranged to advance the insert at the first section toward the second section at a first speed within a first range of speeds and a second unit arranged to advance the insert at the second section away from the first section at a second speed within a second range of speeds so that, owing to its flexibility, the insert sags between said sections when the first speed exceeds the second speed and the extent of sag is adapted to be varied in response to a change of at least one of the first and second speeds;

means for at least partially surrounding the insert with smokable material downstream of said second section including means for at least partially surrounding the insert comprising a suction-operated foraminous conveyor arranged to transport a layer of smokable material downstream of said second section along a second path which is offset relative to a portion of said predetermined path between said sections;

means for bending the insert downstream of said second section of said predetermined path against the layer of smokable material; and means for monitoring the extent of sag of the insert between the first and second sections.

23. The apparatus of claim 22, wherein said monitoring means includes means for generating signals having characteristics denoting the extent of monitored sag, and further comprising means for regulating at least one of said units as a function of the characteristics of said signals.

24. The apparatus of claim 23, wherein the extent of sag of the insert is variable between an upper and a lower threshold value, said regulating means comprising means for adjusting said at least one unit to maintain the extent of sag of the insert between said threshold values.

25. The apparatus of claim 24, wherein said signal generating means includes means for transmitting signals in response to detection of a sag the extent of which at least approximates one of said threshold values.

26. The apparatus of claim 25, wherein said regulating means further comprises means for adjusting said first unit in response to a change of the extent of sag from one of said threshold values to the other of said threshold values within a predetermined interval of time.

27. The apparatus of claim 26, wherein said adjusting means comprises means for selecting for said first unit a speed at which the extent of sag is between said threshold values.

28. The method of claim 24, wherein said signal generating means includes means for transmitting signals for stepwise adjustment of said at least one unit in response to detection that the extent of sag at least approximates one of said threshold values for a predetermined interval of time.

29. The apparatus of claim 22, wherein said means for at least partially surrounding the insert further comprises means for delivering additional smokable material against said layer and against the insert downstream of said second section of said predetermined path.

30. The apparatus of claim 29, further comprising means for equalizing the layer and the additional smokable material downstream of said second section of said predetermined path.

31. The apparatus of claim 22, further comprising means for equalizing the layer.

32. The apparatus of claim 22, wherein said bending means comprises a rotary tool.

33. The apparatus of claim 22, wherein said means for at least partially surrounding the insert with smokable material comprises a foraminous conveyor for smokable material.

34. The apparatus of claim 22, further comprising means for draping the insert and the surrounding smokable material into a wrapper to thus convert the insert, the surrounding smokable material and the wrapper into a cigarette rod.

35. The apparatus of claim 34, wherein the wrapper contains cigarette paper.

* * * * *